US009951731B2

(12) United States Patent
Shingu et al.

(10) Patent No.: US 9,951,731 B2
(45) Date of Patent: Apr. 24, 2018

(54) FUEL INJECTION VALVE AND MANUFACTURING METHOD FOR FUEL INJECTION VALVE

(71) Applicant: Mitsubishi Electric Corporation, Tokyo (JP)

(72) Inventors: Akio Shingu, Tokyo (JP); Norihisa Fukutomi, Tokyo (JP); Manabu Hirai, Kobe (JP); Tsuyoshi Munezane, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/911,283

(22) PCT Filed: Nov. 18, 2013

(86) PCT No.: PCT/JP2013/081033
§ 371 (c)(1),
(2) Date: Feb. 10, 2016

(87) PCT Pub. No.: WO2015/072031
PCT Pub. Date: May 21, 2015

(65) Prior Publication Data

US 2016/0265499 A1 Sep. 15, 2016

(51) Int. Cl.
*F02D 1/06* (2006.01)
*F02M 51/06* (2006.01)
(Continued)

(52) U.S. Cl.
CPC ..... *F02M 51/0682* (2013.01); *B05B 1/18* (2013.01); *F02M 51/06* (2013.01);
(Continued)

(58) Field of Classification Search
CPC .. F02M 51/0682; F02M 51/06; F02M 61/168; F02M 51/061; F02M 1/18;
(Continued)

(56) References Cited

U.S. PATENT DOCUMENTS 5,769,391 A 6/1998 Noller et al.
7,063,279 B2 * 6/2006 Mizuno ..... F02M 51/005 239/585.1
(Continued)

FOREIGN PATENT DOCUMENTS

JP 09-014078 A 1/1997
JP 2007-016774 A 1/2007
(Continued)

OTHER PUBLICATIONS

International Search Report of PCT/JP2013/081033 dated Feb. 18, 2014 [PCT/ISA/210].
(Continued)

*Primary Examiner* — Steven J Ganey
(74) *Attorney, Agent, or Firm* — Sughrue Mion, PLLC; Richard C. Turner

(57) ABSTRACT

A holder of a fuel injection valve is press-inserted to a housing of the fuel injection valve so as to be fixed to the housing, a cap of the fuel injection valve includes a notch portion for notching an annular portion, and is arranged in such a way that an inner circumference surface of the cap is faced to an outer circumference surface of a core of the fuel injection valve via a gap, and an electrode terminal of the fuel injection valve is connected to a terminal of a solenoid of the fuel injection valve via the notch portion of the cap.

7 Claims, 4 Drawing Sheets

(51) Int. Cl.
*B05B 1/18* (2006.01)
*F02M 61/16* (2006.01)

(52) U.S. Cl.
CPC ..... *F02M 51/061* (2013.01); *F02M 61/168* (2013.01); *F02M 2200/8046* (2013.01); *F02M 2200/8061* (2013.01); *F02M 2200/8084* (2013.01)

(58) Field of Classification Search
CPC ... F02M 2200/8046; F02M 2200/8061; F02M 2200/8084; B05B 15/065; B05B 1/185
USPC ..... 239/5, 585.1, 585.4, 585.5, 600, 900
See application file for complete search history.

(56) References Cited

U.S. PATENT DOCUMENTS 8,596,562 B2 * 12/2013 Reiter ..... F02M 51/0682 239/585.1
2003/0168532 A1 9/2003 Maier
2006/0278739 A1 * 12/2006 Nishiwaki ..... F02M 51/0682 239/585.4

FOREIGN PATENT DOCUMENTS

JP 4130771 B2 8/2008
JP 2012-255445 A 12/2012

OTHER PUBLICATIONS

Communication dated Jun. 7, 2016, from the Japanese Patent Office in counterpart application No. 2015-547366.
Communication dated Aug. 31, 2017, from State Intellectual Property Office of the P.R.C. in counterpart application No. 201380080988.0.

* cited by examiner

FUEL INJECTION VALVE AND MANUFACTURING METHOD FOR FUEL INJECTION VALVE

CROSS REFERENCE TO RELATED APPLICATIONS

This application is a National Stage of International Application No. PCT/JP2013/081033, filed Nov. 18, 2013, the contents of which are incorporated herein by reference in its entirety.

BACKGROUND OF THE INVENTION

Technical Field

The present invention relates to a fuel injection valve which is mainly used for a fuel supply system of an internal combustion engine, and relates to a manufacturing method for the fuel injection valve.

Background Art

In a conventional fuel injection valve, a movable valve component, which forms a valve mechanism, is composed of an armature and a valve portion, and the valve component is pressed to a valve washer by a spring when the valve is opened, and when an electrode terminal is energized, a magnetic field, which is generated by a solenoid device, generates a magnetic attractive force by which the armature is aspirated to a core side, whereby the valve component is shifted to the core side, and the valve is opened by producing a gap between the valve portion and the valve washer, and fuel is flowed (for example, refer to Patent Document 1).

Moreover, in a conventional fuel injection valve, a magnetic passage is composed of a core, an armature, a holder, an unequal-diameter-cylindrical-shaped housing, and a cap. A solenoid device is installed in the housing, and the cap is welded and fixed to the housing in such a way that the cap covers the solenoid device in a cap shape. In this case, the housing and the cap are manufactured by a press processing or a squeeze processing, of which cost capability is excellent, so that a notch, which is used as an exit of an electrode terminal, is generally provided at the cap which is easily processed. Moreover, the cap is press-inserted to the holder, so that a gap is formed between the housing and the holder in order to absorb an axis deviation.

In the conventional fuel injection valve, the housing is not a component which contributes to a bending strength of the fuel injection valve, and the bending strength is maintained by the holder and the core. Therefore, a thin portion or the like, by which magnetic saturation is caused, for example, as described in Patent Document 2, is not formed in the holder.

CONVENTIONAL ART DOCUMENT

Patent Document

Patent Document 1: Japanese Patent Publication No. 4130771

Patent Document 2: U.S. Pat. No. 5,769,391

SUMMARY OF THE INVENTION

Problems to be Solved by the Invention

In recent years, FI (Fuel Injection) of an internal combustion engine is evolved in a field of a small displacement motorcycle, and an adoption of a fuel injection valve is increased, so that it is required toward the fuel injection valve that an engine layout capability, in which an attachment length and an outer diameter are downsized, is improved. Moreover, it is required that a capability of injection-amount control, which is equivalent to a capability of injection-amount control of the conventional fuel injection valve, is provided.

However, in the conventional fuel injection valve, a gap is formed between the holder and the housing as described above, so that a magnetic resistance is caused at a magnetic passage by the gap, and a loss of a magnetic flux is caused. Therefore, the fuel injection valve is configured is such a way that a facing area of the holder and the housing is widely maintained so as to suppress the loss of the magnetic flux. As a result, there has been a problem in that an attachment length to a vehicle is increased.

An object of the present invention is to provide a fuel injection valve having a configuration in which an attachment length to a vehicle is shorter than an attachment length of a conventional fuel injection valve and a capability of injection-amount control is not worsened, and to provide a manufacturing method for the fuel injection valve.

Means for Solving Problems

A fuel injection valve of the present invention includes a housing; a holder in which a core is fixed to an end portion in an axis direction; a solenoid which is installed between an inner circumference surface of the housing and the an outer circumference surface of the core; a cap which is welded and fixed to the housing and the core in a state where the solenoid is installed; an armature which is faced to an end portion in an axis direction of the core so as to be arranged, and is held at an inner circumference surface of the holder in a state where the armature is freely slid in an axis direction; a valve portion which is fixed to the armature, and can be seated to or separated from a valve washer which is provided at the holder; a spring which constantly biases the armature in a direction where the armature is separated from the end portion in the axis direction of the core; and an electrode terminal which is arranged at the outside of the housing so as to be connected to the solenoid, in a state where, when an energization for the solenoid is interrupted, the armature is separated from the core by the spring, and the valve portion is seated to the valve washer so as to stop an injection of fuel, and when an energization for the solenoid is performed, a magnetic flux, which is generated in the solenoid, is passed from the core through a magnetic passage which includes the armature, the housing, and the cap, whereby the armature is aspirated by the core so as to be shifted in a direction of the core, and the valve portion is separated from the valve washer so as to inject the fuel; wherein the holder is press-inserted to the housing so as to be fixed to the housing; and the cap includes a notch portion for notching an annular portion, and is arranged in such a way that an inner circumference surface of the cap is faced to the outer circumference surface of the core via a gap; and the electrode terminal is connected to a terminal of the solenoid via the notch portion of the cap.

Moreover, a manufacturing method for the fuel injection valve includes a first process in which the cap and the housing are welded at an opposite side of the notch portion of the cap; and a second process in which the cap and the core are welded in a state where the cap, which is welded in the first process, is displaced in a direction of the notch portion.

Effects of the Invention

According to a fuel injection valve of the present invention, it can be realized that an attachment length L of the fuel injection valve of the present invention is shorter than an attachment length of a conventional fuel injection valve. Moreover, a bending strength of a holder is complemented by the housing, so that the strength of the holder can be easily maintained.

Moreover, according to a manufacturing method for the fuel injection valve of the present invention, a width of a gap between a core and a cap is uniform, and it can be suppressed that a magnetic passage loss between the core and the cap is increased.

MODE FOR CARRYING OUT THE INVENTION

Figure 1:
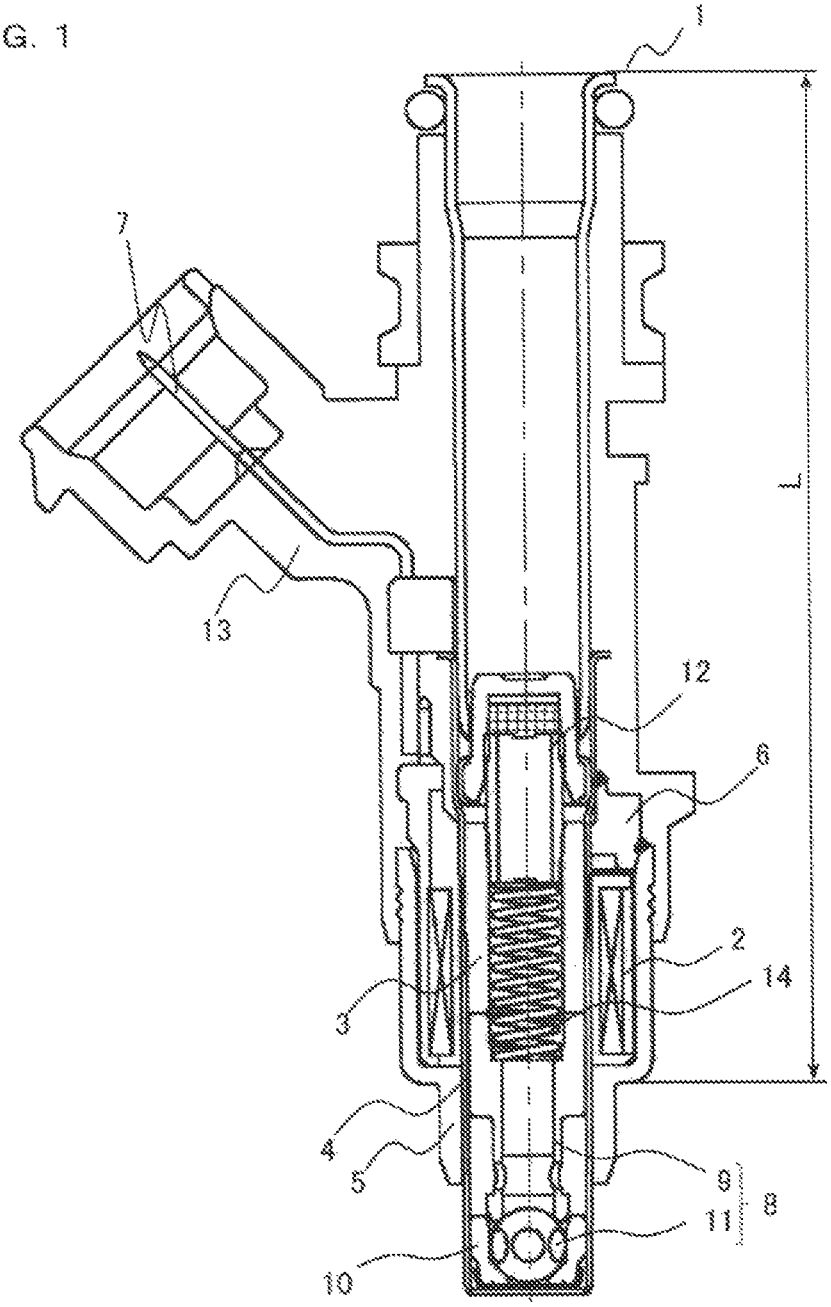
FIG. 1 is a longitudinal cross-sectional view illustrating a fuel injection valve which is a base of the present invention.

Firstly, in order to understand a fuel injection valve according to Embodiment 1 of the present invention, the fuel injection valve, which is a base of the present invention, will be explained. FIG. 1 is a longitudinal cross-sectional view illustrating the fuel injection valve which is the base of the present invention. In FIG. 1, a fuel injection valve 1 includes an unequal-diameter-cylindrical-shaped housing 5, made of a metal, which includes a large diameter portion and a small diameter portion, a hollow-cylindrical-shaped solenoid 2 which is installed in the housing 5, a tube-shaped holder 4 which penetrates the solenoid 2, a cylindrical-shaped core 3 which is press-inserted to the inside of the holder 4, an armature 9 which is faced to one end portion in an axis direction of the core 3 so as to be arranged and is held by the holder 4 in a state where the armature 9 can be moved in an axis direction, a valve portion 11 which is fixed to the armature 9, a valve washer 10, which is fixed in the inside of the holder 4, to which the valve portion 11 is seated or separated from, a cap 6 which is press-inserted to the outside of the holder 4 so as to cover an aperture of the housing 5 in a cap shape, and a spring 14 which is arranged in the inside of the core 3 and pressed by a rod 12 so as to constantly bias the armature 9 in a direction where the armature 9 is separated from the core 3. The housing 5 and the cap 6 are manufactured by a press processing or a squeeze processing, of which cost capability is excellent.

A valve component 8 is composed of the armature 9 and the valve portion 11. A notch is formed in a cap 6, and a terminal of the solenoid 2 is connected to an electrode terminal 7 via the notch of the cap 6. The electrode terminal 7 and the terminal of the solenoid 2 are integrally molded by a connector mold 13 made of an insulating material. The connector mold 13 is fixed to the housing 5.

In the fuel injection valve 1 which is configured as described above, when the solenoid 2 is not energized so as to be set in a non-energized state, the armature 9 is separated from the core 3 by a bias force of the spring 14, and the valve portion 11, which is provided at the armature 9, is seated to the valve washer 10, and a fuel injection hole is closed, and a fuel injection is stopped. In this state, when the solenoid 2 is energized and biased, a magnetic flux, which is generated in the solenoid 2, is passed through a magnetic passage which is composed of the core 3, the armature 9, the holder 4, the housing 5, and the cap 6, and the armature 9 is opposed to the bias force of the spring 14 and is aspirated by the core 3, whereby the armature 9 is shifted to the core 3 side in an axis direction. As a result, the valve portion 11, which is provided at the armature 9, is separated from the valve washer 10, and a gap is formed between the valve washer 10 and the valve portion 11, and fuel is injected from the fuel injection hole to a fuel supply system of an internal combustion engine via the gap. The energization of the solenoid 2 is controlled, whereby a required amount of fuel is injected from the fuel injection valve 1 to the fuel supply system.

As described above, the housing 5 and the cap 6 are manufactured by a press processing or a squeeze processing, of which cost capability is excellent, so that a notch or the like is easily processed. Therefore, a notch portion, which is used for leading the terminal of the solenoid 2, is formed at the cap 6 which is easily processed. The terminal of the solenoid 2 is led from the solenoid 2 via the notch portion, and the terminal of the solenoid 2 is connected to the electrode terminal 7. Moreover, the cap 6 is press-inserted to the outside of the holder 4, so that a gap is formed between the housing 5 and the holder 4 in order to absorb an axis deviation.

In addition, the housing 5 is not a component which contributes to a bending strength of the fuel injection valve 1, and the bending strength is maintained by the holder 4 and the core 3. Therefore, a thin portion or the like, by which magnetic saturation is caused, for example, as described in Patent Document 2, is not formed in the holder 4.

In the fuel injection valve 1 which is configured as described above, the gap is formed between the holder 4 and the housing 5, so that a magnetic resistance is caused at a magnetic passage by the gap, and a loss of a magnetic flux is caused. Therefore, the fuel injection valve 1 is configured is such a way that a facing area of the holder 4 and the housing 5 is widely maintained so as to suppress the loss of the magnetic flux. As a result, there is a problem in that an attachment length L to a vehicle is increased.

Embodiment 1

Figure 2:
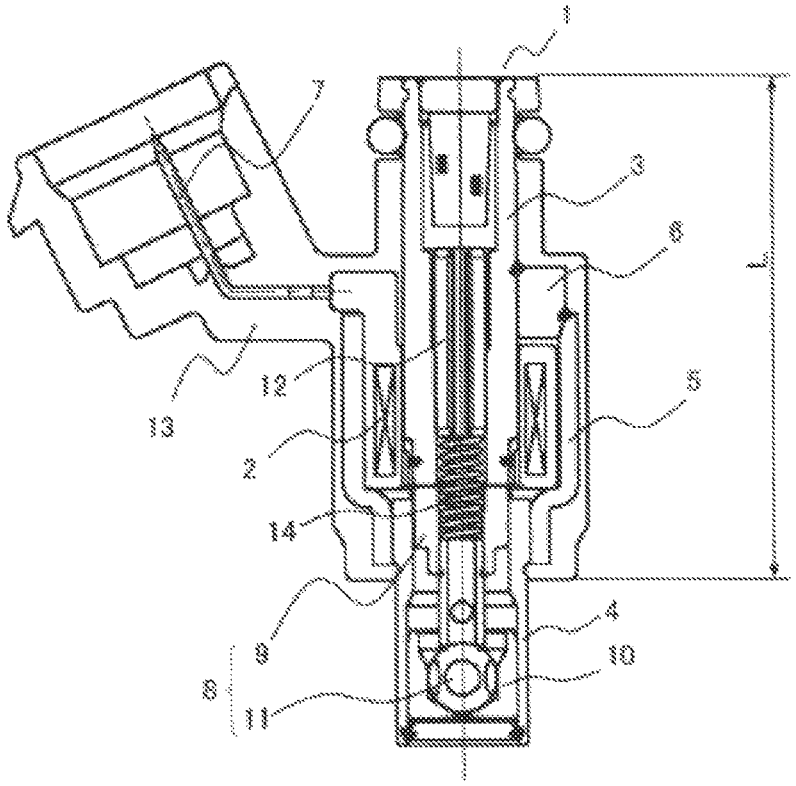
FIG. 2 is a longitudinal cross-sectional view illustrating the fuel injection valve according to Embodiment 1 of the present invention.

Hereinafter, a fuel injection valve according to Embodiment 1 of the present invention will be explained. FIG. 2 is a longitudinal cross-sectional view illustrating the fuel injection valve according to Embodiment 1 of the present invention. In FIG. 2, the fuel injection valve 1 includes the unequal-diameter-cylindrical-shaped housing 5, made of a metal, which includes a large diameter portion and a small diameter portion, the holder 4 of which one end portion is press-inserted to an inner circumference surface of the small diameter portion of the housing 5, the hollow-cylindrical-shaped solenoid 2 which is installed in the large diameter portion of the housing 5, the hollow-cylindrical-shaped core 3 which penetrates the solenoid 2, the armature 9 which is faced to one end portion in an axis direction of the core 3 so as to be arranged and is held by the holder 4 in a state where the armature 9 can be moved in an axis direction, the valve portion 11 which is fixed to the armature 9, the valve washer 10, which is fixed in the inside of the holder 4, to which the valve portion 11 is seated or separated from, the cap 6 which is faced to an outer circumference surface of the core 3 so as to be arranged, and is welded and fixed to the housing 5 so as to cover an aperture of the housing 5 in a cap shape in a state where the cap 6 is pressed to a tapered surface of the aperture of the housing 5, and the spring 14 which is arranged in the inside of the core 3 and pressed by the rod 12 so as to constantly bias the armature 9 in a direction where the armature 9 is separated from the core 3. The housing 5 and the cap 6 are manufactured by a press processing or a squeeze processing, of which cost capability is excellent.

The valve component 8 is composed of the armature 9 and the valve portion 11. A notch, which is described later, is formed in the cap 6, and a terminal of the solenoid 2 is connected to the electrode terminal 7 via the notch of the cap 6. After the electrode terminal 7, the terminal of the solenoid 2, and the solenoid 2 are attached to the housing 5 as described later, those are integrally molded with the housing 5 by the connector mold 13 made of an insulating material.

In the fuel injection valve 1 according to Embodiment 1 of the present invention, which is configured as described above, when the solenoid 2 is not energized so as to be set in a non-energized state, the armature 9 is separated from the core 3 by a bias force of the spring 14, and the valve portion 11, which is provided at the armature 9, is seated to the valve washer 10, and the fuel injection hole is closed, and a fuel injection is stopped. In this state, when the solenoid 2 is energized and biased, a magnetic flux, which is generated in the solenoid 2, is passed through a magnetic passage which is composed of the core 3, the armature 9, the holder 4, the housing 5, and the cap 6, and the armature 9 is opposed to the bias force of the spring 14 and is aspirated by the core 3, whereby the armature 9 is shifted to the core 3 side in an axis direction. As a result, the valve portion 11, which is provided at the armature 9, is separated from the valve washer 10, and a gap is formed between the valve washer 10 and the valve portion 11, and fuel is injected from the fuel injection hole to a fuel supply system of an internal combustion engine via the gap. The energization of the solenoid 2 is controlled, whereby a required amount of fuel is injected from the fuel injection valve 1 to the fuel supply system.

Figure 3:
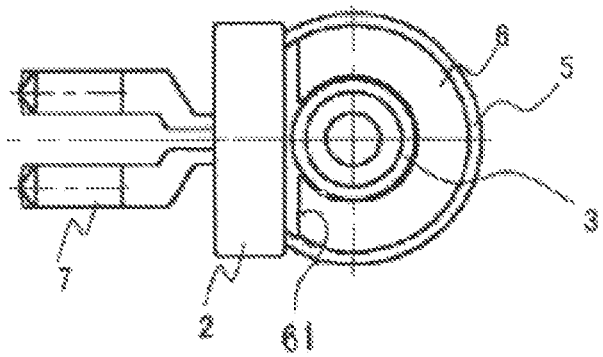
FIG. 3 is a top view illustrating a subassembly of the fuel injection valve according to Embodiment 1 of the present invention.
Figure 4:
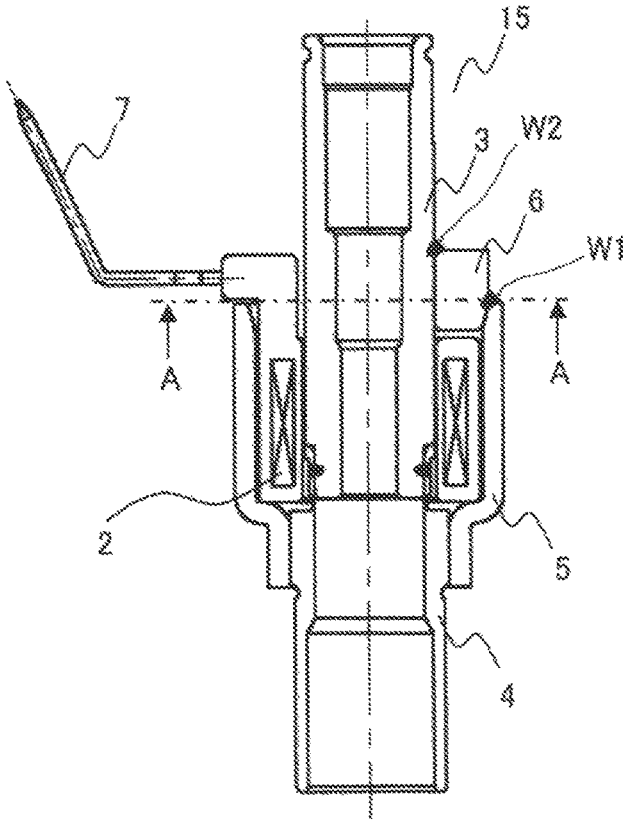
FIG. 4 is a longitudinal cross-sectional view illustrating the subassembly of the fuel injection valve according to Embodiment 1 of the present invention.

Hereinafter, a manufacturing method for the fuel injection valve 1 according to Embodiment 1 of the present invention will be explained. FIG. 3 is a top view illustrating a subassembly of the fuel injection valve 1 according to Embodiment 1 of the present invention, and FIG. 4 is a longitudinal cross-sectional view illustrating the subassembly of the fuel injection valve 1 according to Embodiment 1 of the present invention. In a manufacturing method for a subassembly 15 of the fuel injection valve 1 which is illustrated in FIG. 3 and FIG. 4, the core 3 and the holder 4 are firstly connected in an axis direction, and after the housing 5 is press-inserted and connected to an outer circumference portion of the holder 4, the solenoid 2 is installed in space between the inside of the large diameter portion of the housing 5 and the outer circumference surface of the core 3.

Next, a partial portion of an outer circumference portion of the cap 6 is welded to an aperture end portion of the housing 5, and both portions are fixed, in a state where the cap 6 having a notch 61 is inserted from the core 3 side so as to be pressed to a tapered surface which is formed at an inner circumference surface of the aperture end portion of the housing 5. A symbol "W1", which is illustrated in FIG. 4, indicates a welded portion of the cap 6 and the housing 5. In addition, as described above, although the holder 4, which integrally fixes the core 3 in an axis direction, is press-inserted to the housing 5 so as to be fixed to the housing 5, there is a possibility in which a central axis of the housing 5 is deviated from a central axis of the holder 4 and the core 3 when the holder 4 is fixed. Therefore, in order to absorb the axis deviation, a gap having a predetermined width is formed between the cap 6 and the core 3.

Next, an inner circumference portion of the cap 6 and an outer circumference portion of the core 3 are welded, whereby both portions are fixed. This process is defined as a first process in the present invention. A symbol "W2", which is illustrated in FIG. 4, indicates a welded portion of the cap 6 and the core 3. Lastly, the subassembly 15, which is configured as described above, is inserted and formed by the connector mold 13 which is illustrated in FIG. 2, whereby the fuel injection valve 1 is completed.

Figure 5:
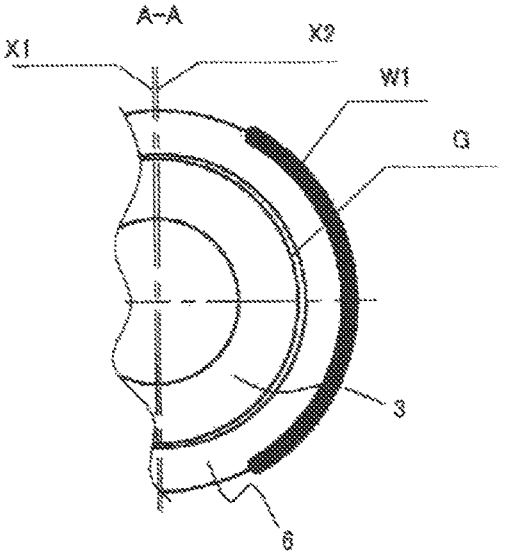
FIG. 5 is a cross-sectional view, along a line "A-A" in FIG. 4, for explaining a process in a manufacturing method for the fuel injection valve according to Embodiment 1 of the present invention.

As described above, the notch 61, which is used for leading the terminal of the solenoid 2, is formed at the cap 6, so that an outer circumference surface of the cap 6 is not formed in a circular shape, and a circular portion is lacked as illustrated in FIG. 3. Therefore, when the outer circumference portion of the cap 6 is welded to the housing 5 at the manufacturing process of the subassembly 15, the cap 6 is constricted by the welding, whereby the cap 6 is deviated to the opposite side of the notch 61. FIG. 5 is a cross-sectional view, along a line "A-A" in FIG. 4, for explaining a process in a manufacturing method for the fuel injection valve 1 according to Embodiment 1 of the present invention, and FIG. 5 indicates a state in which the welding for the cap 6 and the housing 5 is terminated. In other words, as illustrated in FIG. 5, when the outer circumference portion of the cap 6 is welded to the housing 5, in a central axis X1 of the core 3 and the a central axis X2 of the cap 6, which are originally identical, the cap 6 is constricted by the welding, whereby the cap 6 is deviated to the opposite side of the notch 61, and the central axis X2 of the cap 6 is deviated from the central axis X1 of the core 3 to the opposite side of the notch 61 of the cap 6. As a result, a width of a gap G between the outer circumferential surface of the core 3 and the inner circumferential surface of the cap 6 is increased at the opposite side of the notch 61 of the cap 6.

Figure 6:
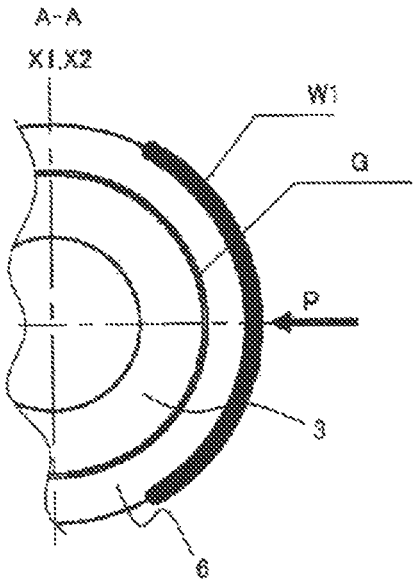
FIG. 6 is a cross-sectional view, along the line "A-A" in FIG. 4, for explaining the other process in the manufacturing method for the fuel injection valve according to Embodiment 1 of the present invention.

FIG. 6 is a cross-sectional view, along the line "A-A" in FIG. 4, for explaining the other process in the manufacturing method for the fuel injection valve 1 according to Embodiment 1 of the present invention, and FIG. 6 indicates a state in which the cap 6 and the core 3 are welded after the welding for the cap 6 and the housing 5 is terminated. As illustrated in FIG. 6, when the cap 6 and the core 3 are welded and fixed, a load P is applied, as indicated by an arrow, by a jig (not illustrated in FIG. 6) in a direction of notch 61 from a central portion of the housing 5 (not illustrated in FIG. 6), which is corresponding to a side at which the notch 61 of the cap 6 is not formed, and an amount of the deviation of the cap 6, which is indicated in FIG. 5, is corrected in such a way that the central axis X2 of the cap 6 is identical to the central axis X1 of the core 3, and then, the cap 6 and the core 3 are welded and fixed. This process is defined as a second process in the present invention.

Thereby, a width of the gap G between the core 3 and the cap 6 is uniform, and it can be suppressed that a magnetic passage loss between the core 3 and the cap 6 is increased, and the core 3 and the cap 6 can be stabilized.

A control method for manufacturing the subassembly 15, which is explained in FIG. 6, can be easily realized in such a way that an outer circumference standard axis of the housing 5 and an outer circumference standard axis of the core 3 are image-processed from an upper stream side of the subassembly 15 (upper side in FIG. 4), and the load P is controlled in a state where an axis deviation between the both axes is set within a constant threshold value.

In the above-described fuel injection valve 1 according to Embodiment 1 of the present invention, the holder 4 is press-inserted and fixed to the housing 5, so that a magnetic passage loss between the housing 5 and the holder 4 can be prevented, and a fit length of the housing 5 toward the holder 4 can be shortened, in other words, it can be realized that an attachment length L of the fuel injection valve 1 of the present invention is shorter than an attachment length of a conventional fuel injection valve. Moreover, the holder 4 is press-inserted and fixed to the housing 5, so that a bending strength of the holder 4 is complemented by the housing 5, and the strength of the holder 4 is easily maintained.

However, when the holder 4 is press-inserted and fixed to the housing 5 as described above, it is required that a gap having a predetermined width is formed between the cap 6 and the core 3 in order to absorb an axis deviation between the holder 4 and the housing 5, so that a magnetic passage loss is caused. Although it is required that a facing area between the cap 6 and the core 3 is increased in order to complement the magnetic passage loss, the notch 61 is formed at the cap 6, so that it is difficult that the facing area is maintained even when a total length of the cap 6 is increased. Moreover, when the cap 6 is constricted at a timing of welding the cap 6 to the housing 5, and a central axis of the cap 6 is deviated to an opposite side of the notch 61 with respect to a central axis of the core 3, a magnetic passage does not exist at the notch 61, so that there is a problem in that the magnetic passage loss is increased.

The above-described problem can be resolved by the manufacturing method for the fuel injection valve 1 according to Embodiment 1 of the present invention. In other words, in the fuel injection valve 1 according to Embodiment 1 of the present invention, an amount of the deviation of the cap 6, which is indicated in FIG. 5, is corrected in such a way that the central axis X2 of the cap 6 is identical to the central axis X1 of the core 3, and then, the cap 6 and the core 3 are welded and fixed, so that a width of the gap G between the core 3 and the cap 6 is uniform, and it can be suppressed that the magnetic passage loss between the core 3 and the cap 6 is increased, and the core 3 and the cap 6 can be stabilized. As a result, the fuel injection valve 1, of which attachment length L of the fuel injection valve 1 of the present invention is shorter than an attachment length of a conventional fuel injection valve, can be obtained, and the fuel injection valve 1, in which a reduction of the attachment length and a capability of injection-amount control are mutually realized, can be obtained.

Embodiment 2

Figure 7:
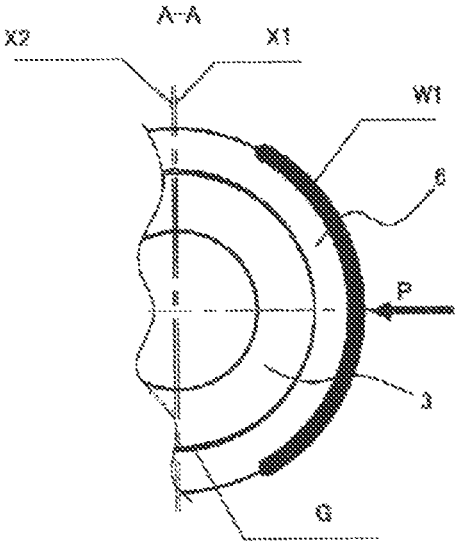
FIG. 7 is a cross-sectional view, along the line "A-A" in FIG. 4, for explaining a process in a manufacturing method for a fuel injection valve according to Embodiment 2 of the present invention.

Hereinafter, a manufacturing method for the fuel injection valve 1 according to Embodiment 2 of the present invention will be explained. FIG. 7 is a cross-sectional view, along the line "A-A" in FIG. 4, for explaining a process in a manufacturing method for the fuel injection valve 1 according to Embodiment 2 of the present invention. In FIG. 7, a central axis X2 of the cap 6 is deviated to the notch 61 side (referred in FIG. 3) of the cap 6 with respect to a central axis X1 of the core 3, and a load P is applied by a jig in a state where the cap 6 is contacted or nearly contacted to the core 3, and the cap 6 and the core 3 are welded and fixed. This process corresponds to the above-described second process. In this case, the load P, by which both axes of the core 3 and the holder 4 are not varied, are set as a upper limit value, whereby it is prevented that a mold-insertion fault or the like is caused when the connector mold 13 is formed. In addition, an outer circumference surface of the housing 5 does not affect to a forming mold of the connector mold 13, so that a minute deformation is allowed.

Moreover, as described above, when the central axis X2 of the cap 6 is deviated to the notch 61 side of the cap 6 with respect to the central axis X1 of the core 3, and the load P is applied by the jig in a state where the cap 6 is contacted or nearly contacted to the core 3, and the cap 6 and the core 3 are welded and fixed, a width of the gap between the core 3 and cap 6 is increased at the notch 61 side of the cap 6 and is decreased at the opposite side of the notch 61 of the cap 6. However, when the welded portion W2 of the core 3 and the cap 6 is positioned at an opposite portion toward the notch 61 of the cap 6, in particular, at a portion which is positioned within 90 degree from an opposite central position of the notch 61 toward both sides, the core 3 and the cap 6 are not welded at a position where a width of the gap is increased, so that it can be suppressed that a variation of the welding is caused.

In addition, in the scope of the present invention, it is possible that each of embodiments is freely combined, or each of embodiments is suitably modified or omitted.

INDUSTRIAL APPLICABILITY

The present invention can be applied in a field of a fuel injection valve, in which fuel is supplied to a fuel supplying system of an internal combustion engine, and can be applied in a field of an internal combustion engine and a vehicle, in which the fuel injection valve is used.

DESCRIPTION OF THE SYMBOLS

"1" is a fuel injection valve; "2," a solenoid; "3," a core; "4," a holder; "5", a housing; "6," a cap; "7," an electrode terminal; "8," a valve component; "9," an armature; "10," a valve washer; "11," a valve portion; "12," a rod; "13," a connector mold; "14," a spring; "15," a subassembly.

What is claimed is:

1. A manufacturing method for a fuel injection valve comprising:

a housing;

a holder in which a core is fixed to an end portion in an axis direction;

a solenoid which is installed between an inner circumference surface of the housing and the an outer circumference surface of the core;

a cap which is welded and fixed to the housing and the core in a state where the solenoid is installed;

an armature which is faced to an end portion in an axis direction of the core so as to be arranged, and is held at an inner circumference surface of the holder in a state where the armature is freely slid in an axis direction;

a valve portion which is fixed to the armature, and can be seated to or separated from a valve washer which is provided at the holder;

a spring which constantly biases the armature in a direction where the armature is separated from the end portion in the axis direction of the core; and an electrode terminal which is arranged at the outside of the housing so as to be connected to the solenoid, in a state where, when an energization for the solenoid is interrupted, the armature is separated from the core by the spring, and the valve portion is seated to the valve washer so as to stop an injection of fuel, and when an energization for the solenoid is performed, a magnetic flux, which is generated in the solenoid, is passed from the core through a magnetic passage which includes the armature, the housing, and the cap, whereby the armature is aspirated by the core so as to be shifted in a direction of the core, and the valve portion is separated from the valve washer so as to inject the fuel; wherein the holder is press-inserted to the housing so as to be fixed to the housing; and the cap includes a notch portion for notching an annular portion, and is arranged in such a way that an inner circumference surface of the cap is faced to the outer circumference surface of the core via a gap; and the electrode terminal is connected to a terminal of the solenoid via the notch portion of the cap, the manufacturing method comprising:

a first process in which the cap and the housing are welded at an opposite side of the notch portion of the cap; and a second process in which the cap and the core are welded in a state where the cap, which is welded in the first process, is displaced in a direction of the notch portion.

2. The manufacturing method for the fuel injection valve as recited in claim 1, wherein the housing includes a large diameter portion and a small diameter portion; and the solenoid is installed in the large diameter portion of the housing; and the holder is press-inserted to the small diameter portion of the housing.

3. The manufacturing method for the fuel injection valve as recited in claim 1, wherein at least the electrode terminal, the housing, and the cap are integrally molded by an insulating material.

4. The manufacturing method for the fuel injection valve as recited in claim 1, wherein in the second process, the cap and the core are welded in a state where the cap is displaced in the direction of the notch portion in such a way that a central axis of the cap is identical to a central axis of the core.

5. The manufacturing method for the fuel injection valve as recited in claim 1, wherein in the second process, the cap and the core are welded in a state where the cap is displaced in the direction of the notch portion in such a way that the central axis of the cap is deviated from the central axis of the core toward the notch portion side.

6. The manufacturing method for the fuel injection valve as recited in claim 5, wherein the cap and the core are welded at portions which are respectively positioned within 90 degree at both sides of an opposite central position toward the notch portion of the cap.

7. A fuel injection valve comprising:

a housing;

a holder in which a core is fixed to an end portion in an axis direction;

a solenoid which is installed between an inner circumference surface of the housing and the an outer circumference surface of the core;

a cap which is welded and fixed to the housing and the core in a state where the solenoid is installed;

an armature which is faced to an end portion in an axis direction of the core so as to be arranged, and is held at an inner circumference surface of the holder in a state where the armature is freely slid in an axis direction;

a valve portion which is fixed to the armature, and can be seated to or separated from a valve washer which is provided at the holder;

a spring which constantly biases the armature in a direction where the armature is separated from the end portion in the axis direction of the core; and an electrode terminal which is arranged at the outside of the housing so as to be connected to the solenoid, in a state where, when an energization for the solenoid is interrupted, the armature is separated from the core by the spring, and the valve portion is seated to the valve washer so as to stop an injection of fuel, and when an energization for the solenoid is performed, a magnetic flux, which is generated in the solenoid, is passed from the core through a magnetic passage which includes the armature, the housing, and the cap, whereby the armature is aspirated by the core so as to be shifted in a direction of the core, and the valve portion is separated from the valve washer so as to inject the fuel; wherein the holder is press-inserted to the housing so as to be fixed to the housing; and the cap includes a notch portion for notching an annular portion, and is arranged in such a way that an inner circumference surface of the cap is faced to the outer circumference surface of the core via a gap;

the electrode terminal is connected to a terminal of the solenoid via the notch portion of the cap; and the shape of the notch portion is a circular segment of the annular portion.

* * * * *